United States Patent [19]

Van Der Straten

[11] Patent Number: 4,856,706

[45] Date of Patent: Aug. 15, 1989

[54] PACKING DEVICE

[75] Inventor: Berend G. Van Der Straten, Deventer, Netherlands

[73] Assignee: Zedek, B.V., Netherlands

[21] Appl. No.: 157,295

[22] Filed: Feb. 17, 1988

[30] Foreign Application Priority Data

Feb. 17, 1987 [NL] Netherlands ..... 8700390

[51] Int. Cl.[4] ..... B65D 5/48

[52] U.S. Cl. ..... 229/110; 206/45.11; 206/45.31; 229/8; 229/120.18

[58] Field of Search ..... 229/8, 120.08, 120.18, 229/107–113, 115, 116, 150; 206/45.11, 583, 591, 594, 45.33, 45.31

[56] References Cited

U.S. PATENT DOCUMENTS

| | | | |
|---|---|---|---|
| 397,980 | 2/1889 | Griest | 206/45.11 |
| 1,108,005 | 8/1914 | Ray | 229/108 |
| 2,126,407 | 8/1938 | Payne et al. | 229/8 |
| 3,082,864 | 3/1963 | Silver | 206/45.31 |
| 3,124,293 | 3/1964 | Transport | 229/112 |
| 3,270,869 | 9/1966 | Burt | 206/45.33 |
| 3,397,771 | 8/1968 | Fogle | 206/45.11 |
| 3,880,342 | 4/1975 | Longo, Jr. | 206/45.11 |
| 4,245,771 | 1/1981 | Christian | 229/150 |
| 4,256,223 | 3/1981 | Pawlowski | 206/45.11 |

FOREIGN PATENT DOCUMENTS

| | | | |
|---|---|---|---|
| 878549 | 2/1980 | Belgium . | |
| 1536138 | 10/1969 | Fed. Rep. of Germany . | |
| 1388002 | 12/1963 | France . | |
| 1452859 | 8/1966 | France . | |
| 1564905 | 3/1969 | France . | |
| 2050532 | 3/1971 | France . | |
| 2324422 | 4/1977 | France . | |
| 75503 | 3/1954 | Netherlands . | |
| 7810935 | 11/1978 | Netherlands . | |
| 755722 | 8/1956 | United Kingdom | 229/8 |
| 2034669 | 6/1980 | United Kingdom . | |

*Primary Examiner*—Gary Elkins

*Attorney, Agent, or Firm*—Majestic, Parsons, Siebert & Hsue

[57] ABSTRACT

A packing device comprising elements which are composed of a bottom, a top panel, at least one end wall and side walls and which are hingeably connected together substantially along the longitudinal ribs of their bottoms to form a continuous row of elements. The packing device has been made from one unitary blank and the row of elements can be rolled up from its flat extended position to a closed polygonal block in which the interconnected bottoms and the combined side walls of the elements form the casing and the end faces, respectively, of the block.

13 Claims, 5 Drawing Sheets

PACKING DEVICE

The invention relates to a packing device comprising elements which are composed of a bottom, a top panel, at least one end wall and side walls and which are hingeably connected together substantially along the longitudinal ribs of their bottoms to form a continuous row of elements. The invention also relates to a unitary blank for the production of the packing device.

A packing device of such a type is known from the Netherlands patent application No. 78.10935. In this known packing device, the elements serving as containers have transverse sections which are adapted to one another in such a manner that the row of elements can be rolled up spirally at one end from the horizontally extended position to a closed prismatic block. In such a block the elements lie against one another with their sloping sides and the bottom of an inwardly lying element matches up with the top of a radially outwardly lying element. The elements of this known rollable and unrollable packing device, which are made in plastic, are suitable for the storage of small objects such as screws, nuts, buttons, cigars, cigarettes and the like.

A disadvantage of this known packing device is that from a manufacturing point of view it requires a complicated production scheme and is therefore relatively expense. Also, in actual practice it has been found a drawback that the hinge joints provided with hinge pins have only a restricted useful life upon repeated rolling and unrolling of the packing device owing to overloading. Moreover, the known packing device is not suited to the storage of larger objects such as bottles, glasses, bags of sweets and the like.

The object of the present invention is to provide an inexpensive packing device which is easy to produce from a manufacturing point of view, which has a long useful life and which is also suitable for the storage of fairly large objects such as bottles, glasses or retail packs of, for instance, sweets.

A packing device of the type mentioned in the introductory paragraph is characterized according to the invention in that the device has been made from one unitary blank and in that the row of elements can be rolled up from its flat extended position to a closed polygonal block in which the interconnected bottoms and the combined side walls of the elements from the casing and the end faces, respectively, of the block.

Since the packing device is made from one unitary blank, its production is simpler and hence more economical from a manufacturing point of view. Another advantage is that the packing device can as a unitary blank be transported and stored more efficiently in great numbers. The present packing device has yet another asset in that it is free from vulnerable hinge joints with a short useful life between contiguous elements. Both the space bounded by the side walls and the end wall(s) of each element and the space between thw end walls of contiguous elements can in the present packing device be utilized for an object to be stored.

One embodiment of a packing device according to the invention is characterized in that it comprises six elements provided with side walls which in elevation have the shape of an isosceles trapezoid and which lie against one another in the rolled-up state of the packing device. In cross-section the block then has the attractive appearance of a regular hexagon.

Another embodiment of a packing device according to the invention is characterized in that at least one element is divided by a partition wall into subelements. This design makes it possible to utilize the space bounded by the side walls and the end wall(s) of each subelement and/or the space available between the end walls of contiguous subelements for an object to be stored.

A further embodiment of a packing device according to the invention is characterized in that it comprises four elements provided with side walls which in elevation have the shape of a rectangular trapezoid. In this manner a packing device of a very attractive appearance is obtained which in its rolled-up state has a highly compact block shape with a square cross-section. This compact block shape ensures good stackability of the packing device.

Yet another embodiment of a packing device according to the invention is characterized in that it comprises four elements provided alternately with side walls which in elevation are isosceles trapezoids and rectangles. This arrangement results in a well stackable packing device with an attractive appearance, having a highly compact block shape with a rectangular cross-section.

The invention will now be elucidated with reference to the accompanying drawings, in which FIG. 1 shows a rolled-up packing device which in section has the shape of a regular hexagon;

Figure 1:
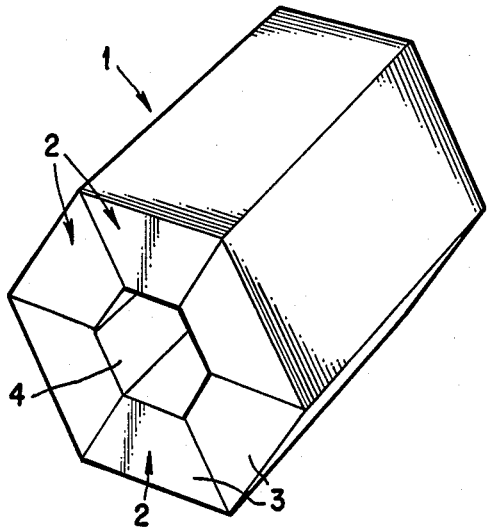

FIG. 1 depicts a rolled-up packing device 1 comprising six elements 2. These elements 2 are provided with side walls 3 which lie together so that in perspective view they have the shape of an isosceles trapezoid. The elements 2 enclose an inward cavity 4.

Figure 2:
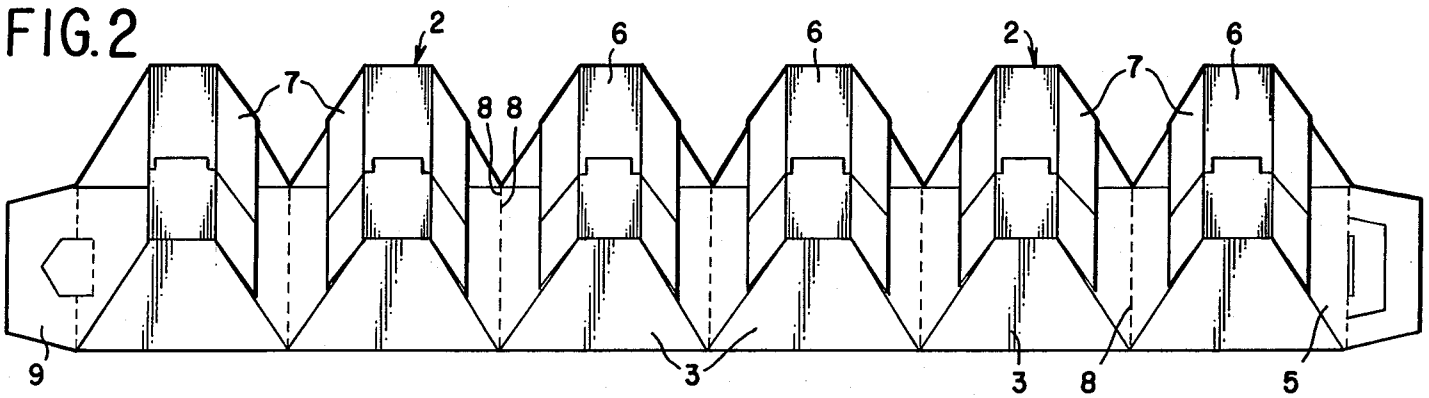
FIG. 2 represents the packing device of FIG. 1 in the unrolled state, with the side walls of the elements having an isosceles trapezoid-shaped elevation.

FIG. 2 shows the packing device of FIG. 1 in the unrolled state. Each element 2 is formed by a bottom 5, a top panel 6, at least one end wall 7 and side walls 3. The element 2 are hingeably connected together along the longitudinal ribs 8 formed between their bottoms 5 to form a continuous row of elements. In the rolled-up state of the packing device, these combined bottoms 5 and the side walls 3 form the casing and the end faces, respectively, of the packing device. One element 2 situated at the end of the row of elements carries at its bottom 5 a tab 9 which, in the rolled-up state of the packing device 1, has to be tucked between the side walls 3 of the element 2 situated at the other extremity of the row of elements.

Figure 3:
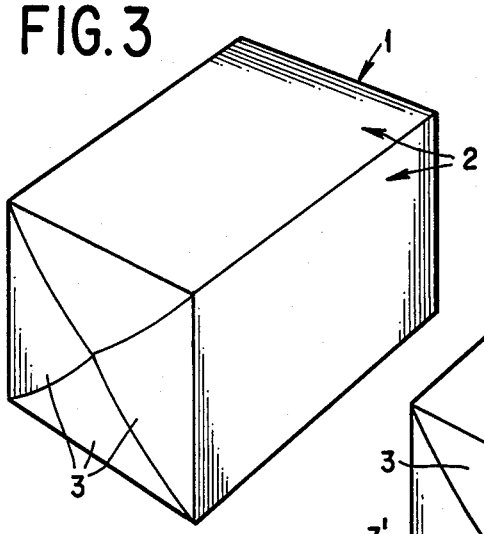
FIG. 3 shows a rolled-up packing device which in section has the shape of a square.
Figure 4:
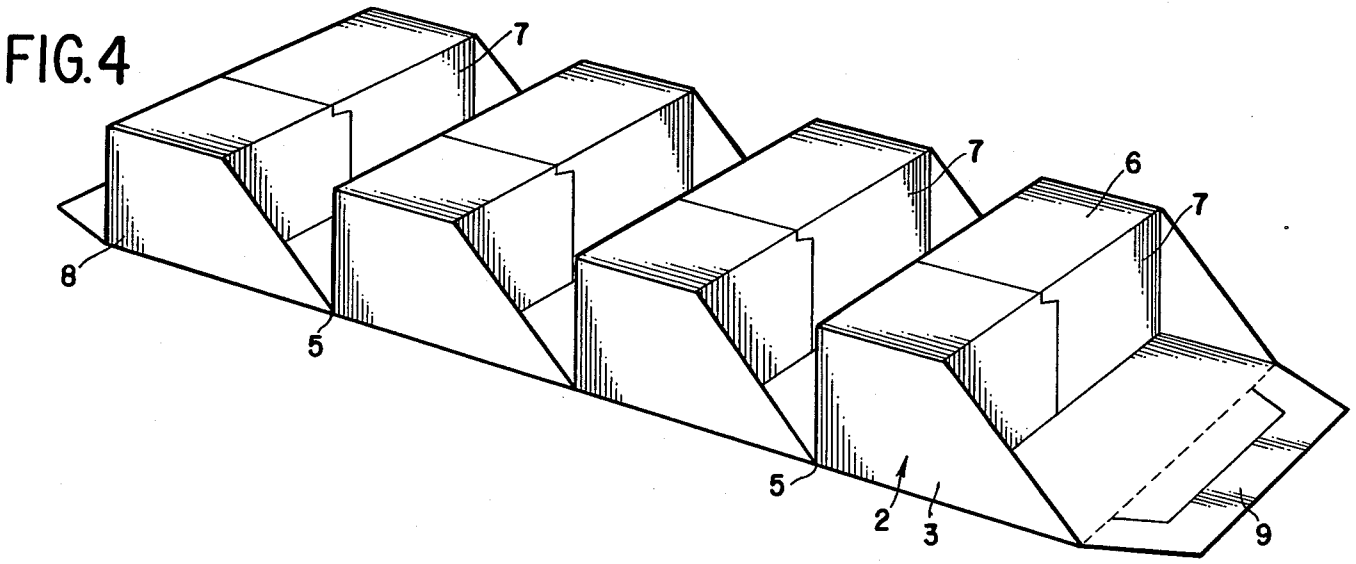
FIG. 4 represents the packing device of FIG. 3 in the unrolled state, with the side walls of the elements having a rectangular trapezoid-shaped elevation.

In the FIGS. 3 and 4, component parts agreeing with those of FIGS. 1 and 2 have been denoted by corresponding reference numerals. Here the side walls 3 have a rectangular trapezoid elevation. When the row of elements is rolled up, these side walls 3 will not lie together but overlap slightly.

Figure 5:
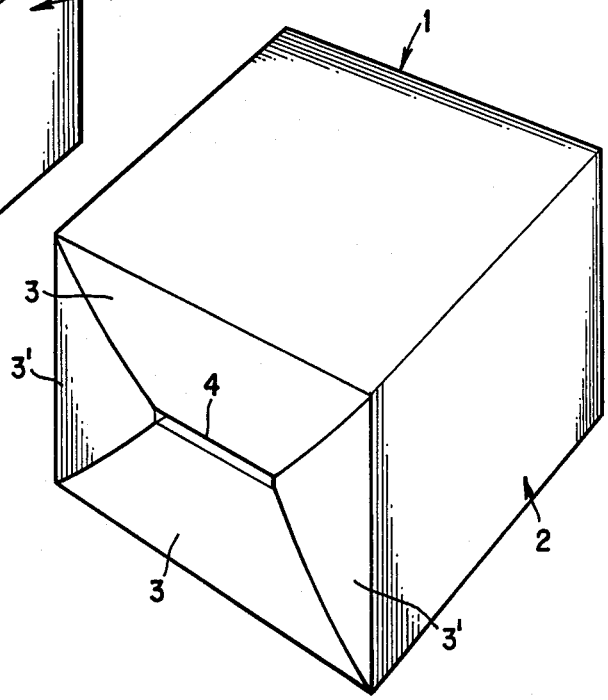
FIG. 5 shows a rolled-up packing device which in section has the shape of a rectangle.
Figure 6:
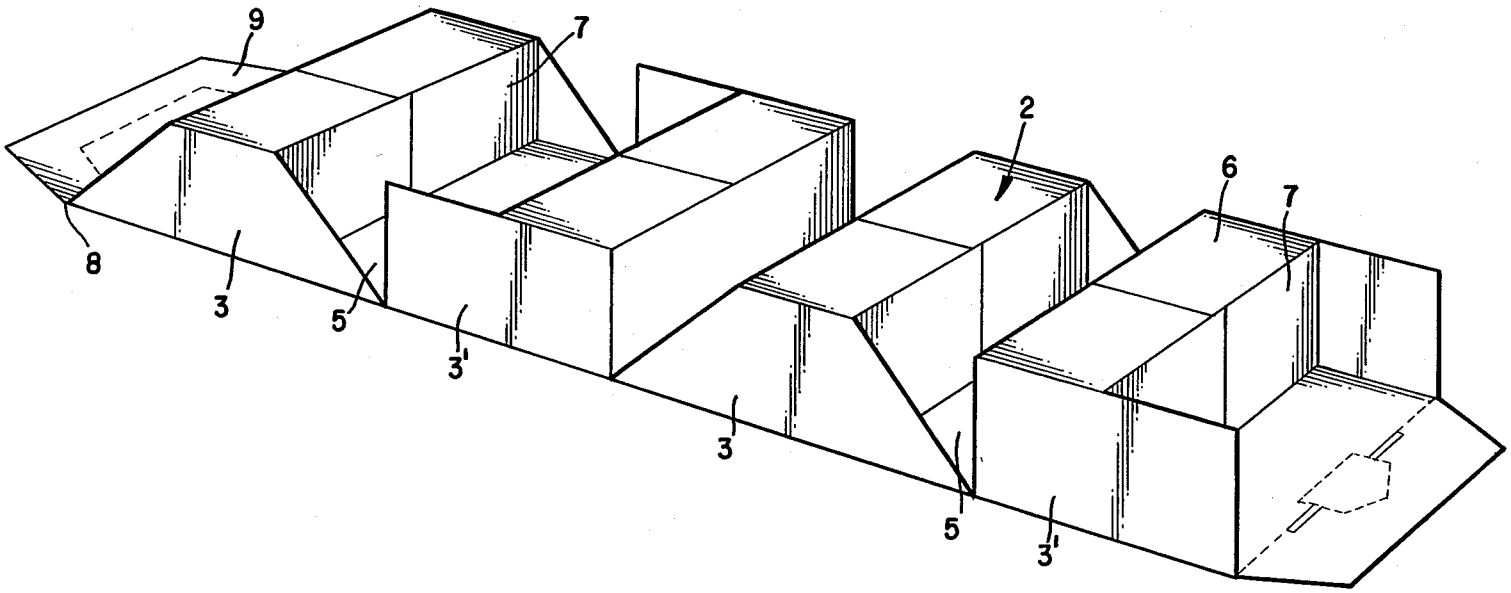
FIG. 6 represents the packing device of FIG. 5 in the unrolled state, in which the elements are provided alternately with side walls of an isosceles trapezoid and a rectangular elevation.

In the FIGS. 5 and 6, component parts agreeing with those of FIGS. 1–4 have again been denoted by corresponding reference numerals. Here the four elements 2 have been provided alternately with isosceles trapezoid and rectangular side walls 3 and 3', respectively. In this design the isosceles trapezoid side walls 3 will slightly overlap the rectangular side walls 3' or conversely, when the row of elements is rolled up.

It is to be observed that in all packing devices of FIGS. 1–6 an object to be stored may be placed both in the space formed by the side walls 3 and the end wall(s) 7 of an element 2 and in the space formed between the end walls 7 of contiguous elements 2. In that case the end wall(s) 7 will invariably serve as lateral support for the object to be stored.

Figure 7:
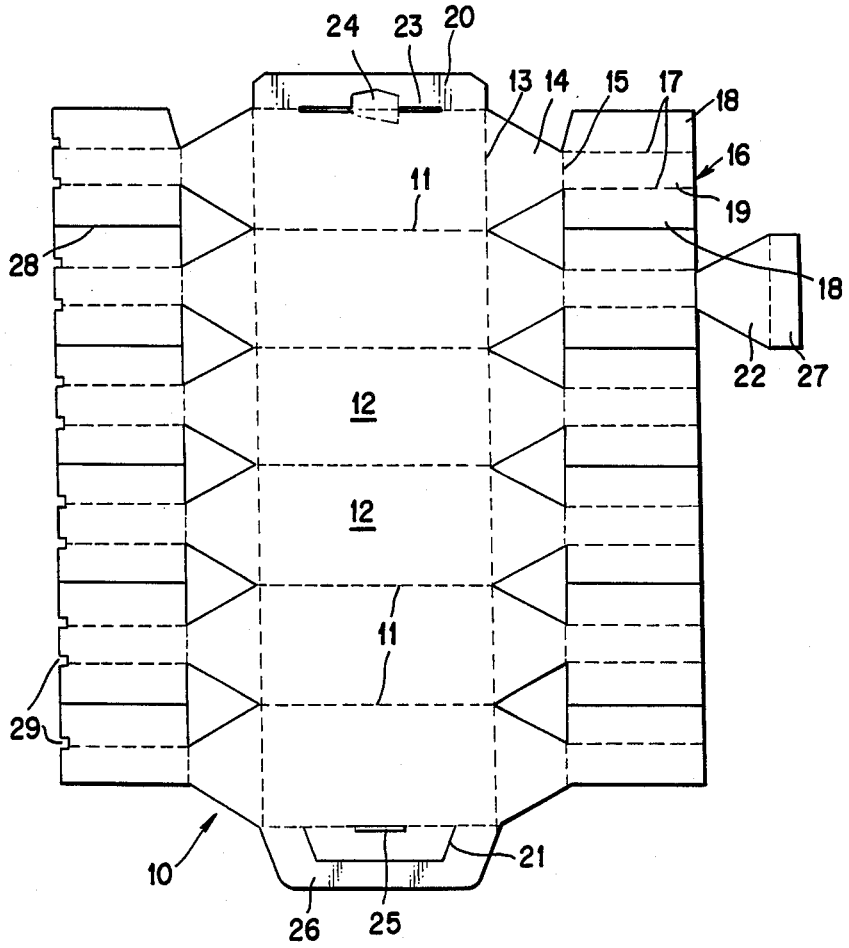
FIG. 7 is a plan view of a unitary blank for the packing device of FIG. 1 with fastening means.

FIG. 7 represents a unitary blank 10 for the production of the packing device 1 of FIG. 1. The unitary blank 10 is divided by primary, mutually parallel folding edges 11 into basal planes 12. These basal planes 12 are each connected at their oppositely located sides through secondary folding edges 13 to wings 14. These wings 14 are in turn connected through third folding edges 15 to strips 16 which are provided with fourth folding edges 17. Each basal plane 12 and each wing 14 form a bottom 5 and a side wall 3, respectively, of an element 2.

Substrips 18 and 19 each form an end wall 7 and a top panel 6, respectively, of an element 2. If required, a strip 16 may also be provided with an additional substrip 22 for the formation of a partition wall serving to divide the appropriate element into subelements. The substrip 22 is to be stuck with its adhesive surface 27 onto a basal plane 12. The basal planes 12 situated at the ends of the unitary blank 10 are both provided with tabs 20 and 21, respectively. The second tab 21 is to be inserted into a cutout 23 of the first tab 20. The first tab 20 also comprises a third tab 24 intended to be inserted into a cutout 25 of the second tab 21. The first tab 20 must itself be tucked between the side walls 3 of the element 2 with the second tab 21. The bottom 5 of the basal plane 12 with the second tab 21 may also comprise a grip 26. The strips 16 are separated from one another by cutting lines 28. When the unitary blank 10 is folded together into the packing device 1, the strips 16 have to be cut loose along these cutting lines 28 in order that any two strips 16 located on both sides of each basal plane 12 may be folded together and stuck to one another. This sticking together of two strips 16 lying against one another need not involve crushing of the material used, if one of the two strips 16 located on both sides of each basal plane 12 is provided with an indentation 29.

Figure 9:
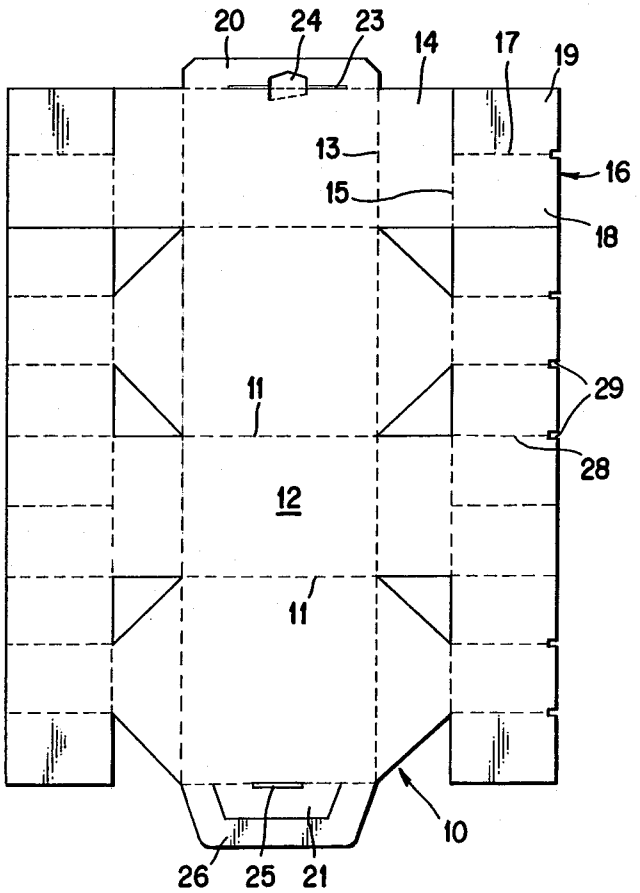
FIG. 9 is a plan view of a unitary blank for the packing device of FIG. 5 with fastening means.
Figure 8:
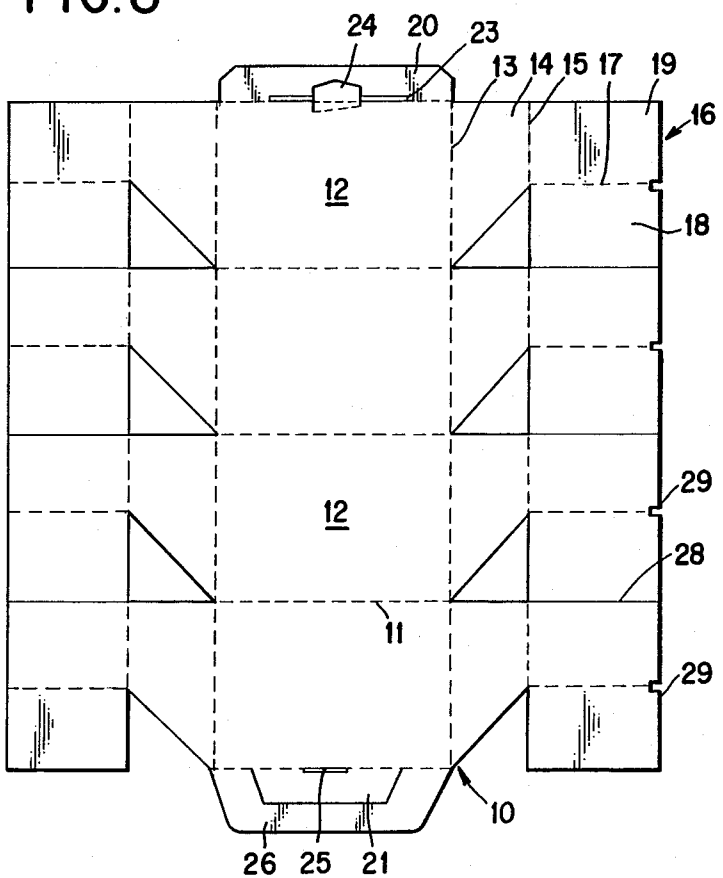
FIG. 8 is a plan view of a unitary blank for the packing device of FIG. 3 with fastening means.

In the FIGS. 8 and 9, component parts agreeing with those of FIG. 7 have been denoted by corresponding reference numerals.

I claim:

1. A packing device comprising a continuous row of at least one element in a flat extended position, each element composed of a bottom, a top panel, at least one end wall and side walls, said elements hingeably connected together substantially along longitudinal ribs formed between said bottoms to form said continuous row of elements, characterized in that the packing device has been made from one unitary blank and that the row of elements can be rolled up from its flat extended position to a closed polygonal block having a casing and end faces in which the interconnected bottoms and said side walls of the elements are combined to form said casing and said end faces, respectively, of said block.

2. A packing device according to claim 1, characterized in that the number of elements is six and said side walls in elevation having the shape of isosceles trapezoids and lying against one another in the rolled-up state of the packing device.

3. A packing device according to claim 2, characterized in that at least one of said elements is divided by a partition wall into subelements.

4. A packing device according to claim 1, characterized in that the number of elements is four and said side walls in elevation having the shape of rectangular trapezoids.

5. A packing device according to claim 1, characterized in that the number of elements is four and said side walls are alernately formed in elevation as isosceles trapezoids and rectangles.

6. A packing device according to claim 1, characterized in that the respective bottoms of the two elements situated each at one end of the row of elements are provided with one tab each, of which the first tab can be tucked into a cutout in the second tab, whilst the second tab is inserted between the side walls of the element with the first tab.

7. A packing device according to claim 6, characterized in that the second tab is provided with a third tab which can be inserted into a cutout in the first tab.

8. A packing device according to claim 6 or 7, characterized in that the bottom of the element with the first tab also has a grip.

9. A unitary blank for the production of a packing device according to claim 1, characterized in that the blank comprises a basal plane which is divided by primary folding edges into basal planes forming said bottoms of said elements, said basal planes each connected at oppositely located sides through secondary folding edges to wings forming said end walls of said element which in turn are each connected along third folding edges lying in parallel to the secondary folding edges to strips provided with fourth folding edges which are perpendicular to the secondary and third folding edges, said strips forming said top panels and side walls of said elements.

10. A unitary blank according to claim 9, characterized in that the wings in elevation have the shape of an isosceles trapezoid.

11. A unitary blank according to claim 10, characterized in that at least one of said strips is connected to a substrip through a fifth folding edge that is parallel to the secondary and third folding edges.

12. A unitary blank according to claim 9, characterized in that the wings in elevation have the shape of a rectangular trapezoid.

13. A unitary blank according to claim 9, characterized in that the wings in elevation have alternately an isosceles trapezoid and a rectangular shape.

* * * * *

UNITED STATES PATENT AND TRADEMARK OFFICE

CERTIFICATE OF CORRECTION

PATENT NO. : 4,856,706

DATED : AUGUST 15, 1989

INVENTOR(S) : BEREND G. VAN DER STRATEN

It is certified that error appears in the above-identified patent and that said Letters Patent is hereby corrected as shown below:

Column 3, line 63, in Claim 1: replace "one element" with --three elements--

Column 4, line 24, in Claim 5: replace "alernately" with --alternately--

Signed and Sealed this

Tenth Day of July, 1990

*Attest:*

HARRY F. MANBECK, JR.

*Attesting Officer*

*Commissioner of Patents and Trademarks*